US008697191B2

(12) United States Patent
Gaab et al.

(10) Patent No.: US 8,697,191 B2
(45) Date of Patent: Apr. 15, 2014

(54) PROCESS FOR COATING A SUPPORT SURFACE WITH A POROUS METAL-ORGANIC FRAMEWORK

(75) Inventors: Manuela Gaab, Schwetzingen (DE); Andrea Weber, Maxdorf (DE); Milan Kostur, Mutterstadt (DE); Ulrich Müller, Neustadt (DE)

(73) Assignee: BASF SE, Ludwigshafen (DE)

( * ) Notice: Subject to any disclaimer, the term of this patent is extended or adjusted under 35 U.S.C. 154(b) by 85 days.

(21) Appl. No.: 13/313,122

(22) Filed: Dec. 7, 2011

(65) Prior Publication Data

US 2012/0141685 A1 Jun. 7, 2012

Related U.S. Application Data

(60) Provisional application No. 61/420,332, filed on Dec. 7, 2010.

(51) Int. Cl.
*B05D 1/02* (2006.01)

(52) U.S. Cl.
USPC ..... 427/372.2; 427/373; 427/384; 427/426

(58) Field of Classification Search
None
See application file for complete search history.

(56) References Cited

U.S. PATENT DOCUMENTS

| | | | | |
|---|---|---|---|---|
| 5,648,508 | A | 7/1997 | Yaghi | |
| 6,383,572 | B1 * | 5/2002 | De Graaf et al. | 427/427.2 |
| 2004/0081611 | A1 | 4/2004 | Muller et al. | |
| 2004/0097724 | A1 | 5/2004 | Muller et al. | |
| 2006/0210458 | A1 | 9/2006 | Mueller et al. | |
| 2008/0227634 | A1 | 9/2008 | Muller et al. | |
| 2009/0183996 | A1 | 7/2009 | Richter et al. | |
| 2010/0126344 | A1 * | 5/2010 | Stein et al. | 95/96 |
| 2010/0166644 | A1 | 7/2010 | Schubert et al. | |
| 2010/0316538 | A1 * | 12/2010 | Buelow et al. | 422/177 |
| 2011/0010826 | A1 | 1/2011 | Kaskel | |
| 2011/0105776 | A1 | 5/2011 | Muller et al. | |

FOREIGN PATENT DOCUMENTS

| | | | |
|---|---|---|---|
| CA | 2704521 | | 5/2009 |
| CN | 101693168 | | 4/2010 |
| CN | 101890305 | | 11/2010 |
| DE | 10111230 | | 9/2002 |
| DE | 102005053430 | | 5/2007 |
| DE | 102006031311 | | 1/2008 |
| EP | 1702925 | | 9/2006 |
| EP | 2578593 | * | 4/2013 |
| WO | WO-2005/003622 | | 1/2005 |
| WO | WO-2005/049892 | | 6/2005 |
| WO | WO-2007/023134 | | 3/2007 |
| WO | WO-2007/131955 | | 11/2007 |
| WO | WO-2009/056184 | | 5/2009 |

OTHER PUBLICATIONS

Abstracts and machine translation of CN 101693168, Apr. 2010.*

Centrone, Andrea et al., "Growth of Metal-Organic Frameworks on Polymer Surfaces", *J. Am. Chem. Soc.*, vol. 132 2010 , 15687-15691.

Chang, Na et al., "Zeolitic Imidazolate Framework-8 Nanocrystal Coated Capillary for Molecular Sieving of Branches Alkanes from Linear Alkanes along with High-Resolution Chromatographic Separation of Linear Alkanes", *J. Am. Chem. Soc.*, vol. 132 2010 , 13645-13647.

Demessence, Aude et al., "Elaboration and properties of hierarchically structured optical thin films of MIL-101(Cr)", *Chem. Commun.* 2009 , 7149-7151.

Gascon, Jorge et al., "Manufacture of dense coatings of Cu3(BTC)2 (HKUST-1) on α-alumina", *Microporous and Mesoporous Materials*, vol. 113 2008 , 132-138.

Guo, Hailing et al., ""Twin Copper Source" Growth of Metal-Organic Framework Membrane: CU3(BTC)2 with High Permeability and Selectivity for Recycling H2", *J. Am. Chem. Soc.*, vol. 131 2009 , 1646-1647.

Hermes, Stephan et al., "Selective Growth and MOCVD Loading of Small Single Crystals of MOF-5 at Alumina and silica Surfaces Modified with Organic Self-Assembled Monolayers", *Chem. Mater.*, vol. 19 2007 , 2168-2173.

Hermes, Stephan et al., "Selective Nucleation and Growth of Metal-Organic Open Framework Thin Films on Patterned COOH/CF3-Terminated Self-Assembled Monolayers on Au(111)", *J. Am. Chem. Soc*, vol. 127 2005 , 13744-13745.

Kusgens, Pia et al., "Crystal Growth of the Metal-Organic Framework Cu3(BTC)2 on the Surface of Pulp Fibers", *Adv. Eng. Mat.*, vol. 11 2009 , 93-95.

Li, Yan-Shuo et al., "Molecular Sieve Membrane: Supported Metal-Organic Framework with High Hydrogen Selectivity", *Angew. Chem. Inst. Ed.*, vol. 49, 2010 , 548-551.

Lu, Guang et al., "Metal-Organic Frameworks as Sensors: A ZIF-8 Based Fabry-Perot Device as a Selective Sensor for Chemical Vapors and Gases", *J. Am. Chem. Soc.*, vol. 132 2010 , 7832-7833.

Schoedel, Alexander et al., "Oriented Nanoscale Films of Metal-Organic Frameworks by Room-Temperature Gel-Layer Synthesis", *Angew. Chem. Int. Ed.*, vol. 49 2010 , 7225-7228.

Shekhah, Osama et al., "Step-by-Step Route for the Synthesis of Metal-Organic Frameworks", *J. Am. Chem. Soc.*, vol. 129 2007 , 15118-15119.

Zacher, Denise et al., "Deposition of microcrystalline [Cu3(btc)2] and [Zn2(bdc)2(dabco)] at alumina and silica surfaces modified with patterned self assembled organic monolayers: evidence of surface selective and oriented growth", *J. Mater. Chem.*, vol. 17 2007 , 2785-2792.

PCT International Search Report & Written Opinion in PCT/IB2011/055446, mailed Apr. 12, 2012, 14 pgs.

* cited by examiner

*Primary Examiner* — Erma Cameron
(74) *Attorney, Agent, or Firm* — Servilla Whitney LLC

(57) ABSTRACT

Described is a process for coating at least part of a surface of a support with a porous metal-organic framework comprising at least one at least bidentate organic compound coordinated to at least one metal ion, which process comprises the steps (a) spraying of the at least one part of the support surface with a first solution comprising the at least one metal ion; (b) spraying of the at least one part of the support surface with a second solution comprising the at least one at least bidentate organic compound, wherein step (b) is carried out before, after or simultaneously with step (a), to form a layer of the porous metal-organic framework.

10 Claims, No Drawings

PROCESS FOR COATING A SUPPORT SURFACE WITH A POROUS METAL-ORGANIC FRAMEWORK

CROSS-REFERENCE TO RELATED APPLICATIONS

This application claims the benefit of priority of provisional application Ser. No. 61/420,332, filed on Dec. 7, 2010, which is incorporated herein by reference in its entirety.

BACKGROUND

1. Technical Field

The present invention relates to a process for coating at least part of a surface of a support with a porous metal-organic framework ("MOF").

2. Background Information

Processes for coating with metal-organic frameworks have been described in the prior art.

WO2009/056184 A1 describes, for example, spraying a suspension comprising a metal-organic framework onto materials such as nonwovens.

DE 10 2006 031 311 A1 proposes applying adsorptive materials such as metal-organic frameworks to support materials by adhesive bonding or another method of fixing.

The formation of a layer of MOF by means of bonding to gold surfaces by means of self-assembly monolayers is described by S. Hermes et al., J. Am. Chem. Soc. 127 (2005), 13744-13745 (see also S. Hermes et al. Chem. Mater. 19 (2007), 2168-2173; D. Zacher et al., J. Mater. Chem. 17 (2007), 2785-2792; O. Shekhah et al., J. Am. Chem. Soc. 129 (2007), 15118-15119; A. Schroedel et al., Angew. Chem. Int. Ed. 49 (2010), 7225-7228).

MOF layers on silicone supports are described by G. Lu, J. Am. Chem. Soc. 132 (2010), 7832-7833.

MOF layers on polyacrylonitrile supports are described by A. Centrone et al., J. Am. Chem. Soc. 132 (2010), 15687-15691.

Copper-benzenetricarboxylate MOF on copper membranes is described by H. Guo et al., J. Am. Chem. Soc. 131 (2009), 1646-1647.

The production of an MOF layer on an aluminum support by dipping and crystal growing is described by Y.-S. Li et al., Angew. Chem. Int. Ed. 49 (2010), 548-551. Similar subject matter is described by J. Gascon et al., Microporous and Mesoporous Materials 113 (2008), 132-138 and A. Demessence et al., Chem. Commun 2009, 7149-7151 and P. Ktisgen et al., Advanced Engineering Materials 11 (2009), 93-95.

The electrodeposition of an MOF film is described by A. Doménech et al., Electrochemistry Communications 8 (2006), 1830-1834.

MOF layers have likewise been used for coating capillaries (N. Chang et al., J. Am. Chem. Soc. 132 (2010), 13645-13647).

Despite the processes for coating a support surface with a porous metal-organic framework, which are known from the prior art, there is a need for improved processes.

The present invention relates to an improved process for coating at least part of a surface of a support with a porous metal-organic framework.

SUMMARY

Embodiments of the present invention are directed toward a process for coating at least part of a surface of a support with a porous metal-organic framework. The metal organic framework comprises at least one at least bidentate organic compound coordinated to at least one metal ion. The process comprises the steps of (a) spraying at least one part of the support surface with a first solution comprising at least one metal ion, and (b) spraying at least one part of the support surface with a second solution comprising at least one at least bidentate compound. Step (b) is carried out before, after, or simultaneously with step (a) to form a layer of porous metal-organic framework.

In one or more embodiments the layer is dried. It can be dried at least 150° C. The layer of the porous metal-organic framework can have a mass in the range of 0.1 $g/m^2$ to 100 $g/m^2$.

In specific embodiments, the spraying with the first, second, or with both solutions is carried out in a spraying drum. The first second, or both solutions can be at room temperature, and the first, second, or both solutions can be aqueous solutions.

In one or more embodiments, the support surface is a fibrous or foam surface.

In specific embodiments, the at least one metal ion is selected from the group of metals consisting of Mg, Ca, Al, and Zn. The at least one bidentate organic compound is derived from a dicarboxylic, tricarboxylic, or tetracarboxylic acid.

DETAILED DESCRIPTION

Before describing several exemplary embodiments of the invention, it is to be understood that the invention is not limited to the details of construction or process steps set forth in the following description. The invention is capable of other embodiments and of being practiced or being carried out in various ways.

Provided is a process for coating at least part of a surface of a support with a porous metal-organic framework comprising at least one at least bidentate organic compound coordinated to at least one metal ion, which process comprises the steps (a) spraying of the at least one part of the support surface with a first solution comprising the at least one metal ion;

(b) spraying of the at least one part of the support surface with a second solution comprising the at least one at least bidentate organic compound, wherein step (b) is carried out before, after or simultaneously with step (a), to form a layer of the porous metal-organic framework.

It has been found that spraying-on of the first and second solution results in spontaneous formation of the metal-organic framework in the form of a layer on the support surface. Here, it is particularly advantageous that homogenous layers can be obtained. Spraying enables a faster production process than dipping processes to be carried out. The adhesion can be increased, so that bonding agents may be able to be dispensed with.

Step (a) can be carried out before step (b). Step (a) can also be carried out after step (b). It is likewise possible for step (a) and step (b) to be carried out simultaneously.

In specific embodiments, the resulting layer of the porous metal-organic framework can be dried. If step (a) and (b) are not carried out simultaneously, a drying step can additionally be carried out between the two steps.

The drying of the resulting layer of the porous metal-organic framework can, in particular, be effected by heating and/or by means of reduced pressure. Heating is carried out, for example, at a temperature in the range from 120° C. to 300° C. In specific embodiments, the layer is dried at least 150° C.

Spraying can be carried out by means of known spraying techniques. In specific embodiments, spraying with the first, second or both with the first and the second solution is carried out in a spraying drum.

The solutions can be at different temperatures or the same temperature. This can be above or below room temperature. The same applies to the support surface. In specific embodiments, the first solution or the second solution or both the first and the second solution is/are at room temperature (22° C.).

The first and second solutions can comprise identical or different solvents. Preference is given to using the same solvent. Possible solvents are solvents known in the prior art. In specific embodiments, the first solution or the second solution or both the first and second solutions is/are an aqueous solution.

The support surface can be a metallic or nonmetallic, optionally modified surface. Preference is given to a fibrous or foam surface.

Particular preference is given to a sheet-like textile structure comprising or consisting of natural fibers and/or synthetic fibers (chemical fibers), in particular with the natural fibers being selected from the group consisting of wool fibers, cotton fibers (CO) and in particular cellulose and/or, in particular, with the synthetic fibers being selected from the group consisting of polyesters (PES); polyolefins, in particular polyethylene (PE) and/or polypropylene (PP); polyvinyl chlorides (CLF); polyvinylidene chlorides (CLF); acetates (CA); triacetates (CTA); polyacrylic (PAN); polyamides (PA), in particular aromatic, preferably flame-resistant polyamides; polyvinyl alcohols (PVAL); polyurethanes; polyvinyl esters; (meth)acrylates; polylactic acids (PLA); activated carbon; and mixtures thereof.

Particular preference is given to foams for sealing and insulation, acoustic foams, rigid foams for packaging and flame-resistant foams composed of polyurethane, polystyrene, polyethylene, polypropylene, PVC, viscose, cellular rubber and mixtures thereof. In specific embodiments, preference is given to foam composed of melamine resin (Basotect).

A particularly suitable support material is filter material (including dressing material, cotton cloths, cigarette filters, filter papers as can, for example, be procured commercially for laboratory use).

The first solution comprises the at least one metal ion. This can be used as metal salt. The second solution comprises the at least one at least bidentate organic compound. This can preferably be in the form of a solution of its salt.

The at least one metal ion and the at least one at least bidentate organic compound form the porous metal-organic framework by contacting the two solutions directly on the support surface to form a layer. Metal-organic frameworks which can be produced in this way are known in the prior art.

Such metal-organic frameworks (MOF) are, for example, described in U.S. Pat. No. 5,648,508, EP-A-0 790 253, M. O'Keeffe et al., J. Sol. State Chem., 152 (2000), pages 3 to 20, H. Li et al., Nature 402, (1999), page 276, M. Eddaoudi et al., Topics in Catalysis 9, (1999), pages 105 to 111, B. Chen et al., Science 291, (2001), pages 1021 to 1023, DE-A-101 11 230, DE-A 10 2005 053430, WO-A 2007/054581, WO-A 2005/049892 and WO-A 2007/023134.

As a specific group of these metal-organic frameworks, "limited" frameworks in which, as a result of specific selection of the organic compound, the framework does not extend infinitely but forms polyhedra are described in the recent literature. A. C. Sudik, et al., J. Am. Chem. Soc. 127 (2005), 7110-7118, describe such specific frameworks. Here, they will be described as metal-organic polyhedra (MOP) to distinguish them.

A further specific group of porous metal-organic frameworks comprises those in which the organic compound as ligand is a monocyclic, bicyclic or polycyclic ring system which is derived at least from one of the heterocycles selected from the group consisting of pyrrole, alpha-pyridone and gamma-pyridone and has at least two ring nitrogens. The electrochemical preparation of such frameworks is described in WO-A 2007/131955.

The general suitability of metal-organic frameworks for absorbing gases and liquids is described, for example, in WO-A 2005/003622 and EP-A 1 702 925

These specific groups are particularly suitable for the purposes of the present invention.

The metal-organic frameworks according to the present invention comprise pores, in particular micropores and/or mesopores. Micropores are defined as pores having a diameter of 2 nm or less and mesopores are defined by a diameter in the range from 2 to 50 nm, in each case corresponding to the definition given in Pure & Applied Chem. 57 (1983), 603-619, in particular on page 606. The presence of micropores and/or mesopores can be checked by means of sorption measurements which determine the absorption capacity of the MOF for nitrogen at 77 kelvin in accordance with DIN 66131 and/or DIN 66134.

The specific surface area, calculated according to the Langmuir model (DIN 66131, 66134), of an MOF is preferably greater than 10 $m^2/g$, more preferably greater than 20 $m^2/g$, more preferably greater than 50 $m^2/g$. Depending on the MOF, it is also possible to achieve greater than 100 $m^2/g$, more preferably greater than 150 $m^2/g$ and particularly preferably greater than 200 $m^2/g$.

In specific embodiments, the metal component in the framework according to the present invention is selected from groups Ia, IIa, IIIa, IVa to VIIIa and Ib to VIb of the periodic table. Particular preference is given to the metals Mg, Ca, Sr, Ba, Sc, Y, Ln, Ti, Zr, Hf, V, Nb, Ta, Cr, Mo, W, Mn, Re, Fe, Ro, Os, Co, Rh, Ir, Ni, Pd, Pt, Cu, Ag, Au, Zn, Cd, Hg, Al, Ga, In, Tl, Si, Ge, Sn, Pb, As, Sb and Bi, where Ln represents lanthanides.

Lanthanides (Ln) are La, Ce, Pr, Nd, Pm, Sm, En, Gd, Tb, Dy, Ho, Er, Tm, Yb.

As regards the ions of these elements, particular mention may be made of $Mg^{2+}$, $Ca^{2+}$, $Sr^{2+}$, $Ba^{2+}$, $Sc^{3+}$, $Y^{3+}$, $Ln^{3+}$, $Ti^{4+}$, $Zr^{4+}$, $Hf^{4+}$, $V^{4+}$, $V^{3+}$, $V^{2+}$, $Nb^{3+}$, $Ta^{3+}$, $Cr^{3+}$, $Mo^{3+}$, $W^{3+}$, $Mn^{3+}$, $Mn^{2+}$, $Re^{3+}$, $Re^{2+}$, $Fe^{3+}$, $Fe^{2+}$, $Ru^{3+}$, $Ru^{2+}$, $Os^{3+}$, $Os^{2+}$, $Co^{3+}$, $Co^{2+}$, $Rh^{2+}$, $Rh^{+}$, $Ir^{2+}$, $Ir^{+}$, $Ni^{2+}$, $Ni^{+}$, $Pd^{2+}$, $Pd^{+}$, $Pt^{2+}$, $Pt^{+}$, $Cu^{2+}$, $Cu^{+}$, $Ag^{+}$, $Au^{+}$, $Zn^{2+}$, $Cd^{2+}$, $Hg^{2+}$, $Al^{3+}$, $Ga^{3+}$, $In^{3+}$, $Tl^{3+}$, $Si^{4+}$, $Si^{2+}$, $Ge^{4+}$, $Ge^{2+}$, $Sn^{4+}$, $Sn^{2+}$, $Pb^{4+}$, $Pb^{2+}$, $As^{5+}$, $As^{3+}$, $As^{+}$, $Sb^{5+}$, $Sb^{3+}$, $Sb^{+}$, $Bi^{5+}$, $Bi^{3+}$ and $Bi^{+}$.

In specific embodiments, preference is given to Mg, Ca, Al, Y, Sc, Zr, Ti, V, Cr, Mo, Fe, Co, Cu, Ni, Zn, Ln. Greater preference is given to Mg, Ca, Al, Mo, Y, Sc, Mg, Fe, Cu and Zn. In particular, Mg, Ca, Sc, Al, Cu and Zn are preferred. In specific embodiments, the metal component in the framework is selected from the group consisting of Mg, Ca, Al and Zn, in particular Al.

The term "at least bidentate organic compound" refers to an organic compound which comprises at least one functional group which is able to form at least two coordinate bonds to a given metal ion and/or to form one coordinate bond to each of two or more, preferably two, metal atoms.

As functional groups via which the abovementioned coordinate bonds are formed, particular mention may be made by way of example of the following functional groups: —$CO_2H$, —$CS_2H$, —$NO_2$, —$B(OH)_2$, —$SO_3H$, —$Si(OH)_3$, —$Ge(OH)_3$, —$Sn(OH)_3$, —$Si(SH)_4$, —$Ge(SH)_4$, —$Sn(SH)_3$, —$PO_3H$, —$AsO_3H$, —$AsO_4H$, —$P(SH)_3$, —$As(SH)_3$, —$CH(RSH)_2$, —$C(RSH)_3$—$CH(RNH_2)_2$—$C(RNH_2)_3$, —$CH(ROH)_2$, —$C(ROH)_3$, —$CH(RCN)_2$, —$C(RCN)_3$, where R is, for example, preferably an alkylene group having 1, 2, 3, 4 or 5 carbon atoms, for example a methylene, ethylene, n-propylene, i-propylene, n-butylene, i-butylene, tert-butylene or n-pentylene group, or an aryl group comprising 1 or 2 aromatic rings, for example 2 $C_6$ rings, which may optionally be fused and may, independently of one another, be appropriately substituted by at least one substituent in each case and/or may, independently of one another, in each case comprise at least one heteroatom such as N, O and/or S. In likewise specific embodiments, mention may be made of functional groups in which the abovementioned radical R is not present. In this respect, mention may be made of, inter alfa, —$CH(SH)_2$, —$C(SH)_3$, —$CH(NH_2)_2$, —$C(NH_2)_3$, —$CH(OH)_2$, —$C(OH)_3$, —$CH(CN)_2$ or —$C(CN)_3$.

However, the functional groups can also be heteroatoms of a heterocycle. Particular mention may here be made of nitrogen atoms.

The at least two functional groups can in principle be bound to any suitable organic compound as long as it is ensured that the organic compound bearing these functional groups is capable of forming the coordinate bond and of producing the framework.

In specific embodiments, the organic compounds comprising the at least two functional groups are derived from a saturated or unsaturated aliphatic compound or an aromatic compound or a both aliphatic and aromatic compound.

The aliphatic compound or the aliphatic part of the both aliphatic and aromatic compound can be linear and/or branched and/or cyclic, with a plurality of rings per compound also being possible. The aliphatic compound or the aliphatic part of the both aliphatic and aromatic compound more preferably comprises from 1 to 15, more preferably from 1 to 14, more preferably from 1 to 13, more preferably from 1 to 12, more preferably from 1 to 11 and particularly preferably from 1 to 10, carbon atoms, for example 1, 2, 3, 4, 5, 6, 7, 8, 9 or 10 carbon atoms. Particular preference is given here to, inter alia, methane, adamantane, acetylene, ethylene or butadiene.

The aromatic compound or the aromatic part of the both aromatic and aliphatic compound can have one or more rings, for example two, three, four or five rings, with the rings being able to be present separately from one another and/or at least two rings being able to be present in fused form. The aromatic compound or the aromatic part of the both aliphatic and aromatic compound particularly has one, two or three rings, with one or two rings being particularly preferred. Furthermore, each ring of said compound can independently comprise at least one heteroatom, for example N, O, S, B, P, Si, AI, preferably N, O and/or S. The aromatic compound or the aromatic part of the both aromatic and aliphatic compound more preferably comprises one or two $C_6$ rings, with the two being present either separately from one another or in fused form. In particular, mention may be made of benzene, naphthalene and/or biphenyl and/or bipyridyl and/or pyridyl as aromatic compounds.

In specific embodiments, the at least bidentate organic compound is an aliphatic or aromatic, acyclic or cyclic hydrocarbon which has from 1 to 18, preferably from 1 to 10 and in particular 6, carbon atoms and additionally has exclusively 2, 3 or 4 carboxyl groups as functional groups.

In specific embodiments, the at least one at least bidentate organic compound is derived from a dicarboxylic, tricarboxylic or tetracarboxylic acid.

For example, the at least bidentate organic compound is derived from a dicarboxylic acid such as oxalic acid, succinic acid, tartaric acid, 1,4-butanedicarboxylic acid, 1,4-butenedicarboxylic acid, 4-oxopyran-2,6-dicarboxylic acid, 1,6-hexanedicarboxylic acid, decanedicarboxylic acid, 1,8-heptadecanedicarboxylic acid, 1,9-heptadecanedicarboxlic acid, heptadecanedicarboxylic acid, acetylenedicarboxylic acid, 1,2-benzenedicarboxylic acid, 1,3-benzenedicarboxylic acid, 2,3-pyridinedicarboxylic acid, pyridine-2,3-dicarboxylic acid, 1,3-butadiene-1,4-dicarboxylic acid, 1,4-benzenedicarboxylic acid, p-benzenedicarboxylic acid, imidazole-2,4-dicarboxylic acid, 2-methylquinoline-3,4-dicarboxylic acid, quinoline-2,4-dicarboxylic acid, quinoxaline-2,3-dicarboxylic acid, 6-chloroquinoxaline-2,3-dicarboxylic acid, 4,4'-diaminophenylmethane-3,3'-dicarboxylic acid, quinoline-3,4-dicarboxylic acid, 7-chloro-4-hydroxyquinoline-2,8-dicarboxylic acid, diimidedicarboxylic acid, pyridine-2,6-dicarboxylic acid, 2-methylimidazole-4,5-dicarboxylic acid, thiophene-3,4-dicarboxylic acid, 2-isopropylimidazole-4,5-dicarboxylic acid, tetrahydropyran-4,4-dicarboxylic acid, perylene-3,9-dicarboxylic acid, perylenedicarboxylic acid, Pluriol E 200-dicarboxylic acid, 3,6-dioxaoctanedicarboxylic acid, 3,5-cyclohexadiene-1,2-dicarboxylic acid, octanedicarboxylic acid, pentane-3,3-dicarboxylic acid, 4,4'-diamino-1,1'-biphenyl-3,3'-dicarboxylic acid, 4,4'-diaminobiphenyl-3,3'-dicarboxylic acid, benzidine-3,3'-dicarboxylic acid, 1,4-bis(phenylamino)benzene-2,5-dicarboxylic acid, 1,1'-binaphthyldicarboxylic acid, 7-chloro-8-methylquinoline-2,3-dicarboxylic acid, 1-anilinoanthraquinone-2,4'-dicarboxylic acid, polytetrahydrofuran 250-dicarboxylic acid, 1,4-bis(carboxymethyl)piperazine-2,3-dicarboxylic acid, 7-chloroquinoline-3,8-dicarboxylic acid, 1-(4-carboxy)phenyl-3-(4-chloro)phenylpyrazoline-4,5-dicarboxylic acid, 1,4,5,6,7,7-hexachloro-5-norbornene-2,3-dicarboxylic acid, phenylindanedicarboxylic acid, 1,3-dibenzyl-2-oxoimidazolidine-4,5-dicarboxylic acid, 1,4-cyclohexanedicarboxylic acid, naphthalene-1,8-dicarboxylic acid, 2-benzoylbenzene-1,3-dicarboxylic acid, 1,3-dibenzyl-2-oxoimidazolidene-4,5-cis-dicarboxylic acid, 2,2'-biquinoline-4,4'-dicarboxylic acid, pyridine-3,4-dicarboxylic acid, 3,6,9-trioxaundecanedicarboxylic acid, hydroxybenzophenonedicarboxylic acid, Pluriol E 300-dicarboxylic acid, Pluriol E 400-dicarboxylic acid, Pluriol E 600-dicarboxylic acid, pyrazole-3,4-dicarboxylic acid, 2,3-pyrazinedicarboxylic acid, 5,6-dimethyl-2,3-pyrazinedicarboxylic acid, 4,4'-diamino(diphenyl ether)diimidedicarboxylic acid, 4,4'-diaminodiphenylmethanediimidedicarboxylic acid, 4,4'-diamino(diphenyl sulfone) diimidedicarboxylic acid, 1,4-naphthalenedicarboxylic acid, 2,6-naphthalenedicarboxylic acid, 1,3-adamantanedicarboxylic acid, 1,8-naphthalenedicarboxylic acid, 2,3-naphthalenedicarboxylic acid, 8-methoxy-2,3-naphthalenedicarboxylic acid, 8-nitro-2,3-naphthalenedicarboxylic acid, 8-sulfo-2,3-naphthalenedicarboxylic acid, anthracene-2,3-dicarboxylic acid, 2',3'-diphenyl-p-terphenyl-4,4"-dicarboxylic acid, (diphenyl ether)-4,4'-dicarboxylic acid, imidazole-4,5-dicarboxylic acid, 4(1H)-oxothiochromene-2,8-dicarboxylic acid, 5-tert-butyl-1,3-benzenedicarboxylic acid, 7,8-quinolinedicarboxylic acid, 4,5-imidazoledicarboxylic acid, 4-cyclohexene-1,2-dicarboxylic acid, hexatriacontanedicarboxylic acid, tetradecanedicarboxylic acid, 1,7-heptanedicarboxylic acid, 5-hydroxy-1,3-benzenedicarboxylic acid, 2,5-dihydroxy-1,4-dicarboxylic acid, pyrazine-2,3-dicarboxylic acid, furan-2,5-dicarboxylic acid, 1-nonene-6,9-dicarboxylic acid, eicosenedicarboxylic acid, 4,4'-dihydroxydiphenylmethane-3,3'-dicarboxylic acid, 1-amino-4-methyl-9,10-dioxo-9,10-dihydroanthracene-2,3-dicarboxylic acid, 2,5-pyridinedicarboxylic acid, cyclohexene-2,3-dicarboxylic acid, 2,9-dichlorofluorubin-4,11-dicarboxylic acid, 7-chloro-3-methylquinoline-6,8-dicarboxylic acid, 2,4-dichlorbenzophenone-2',5'-dicarboxylic acid, 1,3-benzenedicarboxylic acid, 2,6-pyridinedicarboxylic acid, 1-methylpyrrole-3,4-dicarboxylic acid, 1-benzyl-1H-pyrrole-3,4-dicarboxylic acid, anthraquinone-1,5-dicarboxylic acid, 3,5-pyrazoledicarboxylic acid, 2-nitrobenzene-1,4-dicarboxylic acid, heptane-1,7-dicarboxylic acid, cyclobutane-1,1-dicarboxylic acid 1,14-tetradecanedicarboxylic acid, 5,6-dehydronorbornane-2,3-dicarboxylic acid, 5-ethyl-2,3-pyridinedicarboxylic acid or camphordicarboxylic acid, Furthermore, in specific embodiments, the at least bidentate organic compound is one of the dicarboxylic acids mentioned by way of example above as such.

The at least bidentate organic compound can, for example, be derived from a tricarboxylic acid such as 2-hydroxy-1,2,3-propanetricarboxylic acid, 7-chloro-2,3,8-quinolinetricarboxylic acid, 1,2,3-, 1,2,4-benzenetricarboxylic acid, 1,2,4-butanetricarboxylic acid, 2-phosphono-1,2,4-butanetricarboxylic acid, 1,3,5-benzenetricarboxylic acid, 1-hydroxy-1,2,3-propanetricarboxylic acid, 4,5-dihydro-4,5-dioxo-1H-pyrrolo[2,3-F]quinoline-2,7,9-tricarboxylic acid, 5-acetyl-3-amino-6-methylbenzene-1,2,4-tricarboxylic acid, 3-amino-5-benzoyl-6-methylbenzene-1,2,4-tricarboxylic acid, 1,2,3-propanetricarboxylic acid or aurintricarboxylic acid.

Furthermore, in specific embodiments, the at least bidentate organic compound is one of the tricarboxylic acids mentioned by way of example above as such.

Examples of an at least bidentate organic compound derived from a tetracarboxylic acid are 1,1-dioxidoperylo[1,12-BCD]thiophene-3,4,9,10-tetracarboxylic acid, perylenetetracarboxylic acids such as perylene-3,4,9,10-tetracarboxylic acid or (perylene-1,12-sulfone)-3,4,9,10-tetracarboxylic acid, butanetetracarboxylic acids such as 1,2,3,4-butanetetracarboxylic acid or meso-1,2,3,4-butanetetracarboxylic acid, decane-2,4,6,8-tetracarboxylic acid, 1,4,7,10,13,16-hexaoxacyclooctadecane-2,3,11,12-tetracarboxylic acid, 1,2,4,5-benzenetetracarboxylic acid, 1,2,11,12-dodecanetetracarboxylic acid, 1,2,5,6-hexanetetracarboxylic acid, 1,2,7,8-octanetetracarboxylic acid, 1,4,5,8-naphthalenetetracarboxylic acid, 1,2,9,10-decanetetracarboxylic acid, benzo-phenonetetracarboxylic acid, 3,3',4,4'-benzophenonetetracarboxylic acid, tetrahydrofurantetracarboxylic acid or cyclopentanetetracarboxylic acids such as cyclopentane-1,2,3,4-tetracarboxylic acid.

Furthermore, in specific embodiments, the at least bidentate organic compound is one of the tetracarboxylic acids mentioned by way of example above as such.

Preferred heterocycles as at least bidentate organic compound in which a coordinate bond is formed via the ring heteroatoms are the following substituted or unsubstituted ring systems:

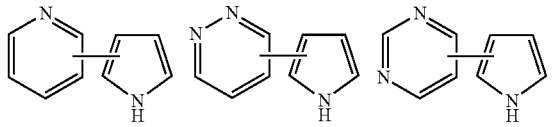

-continued

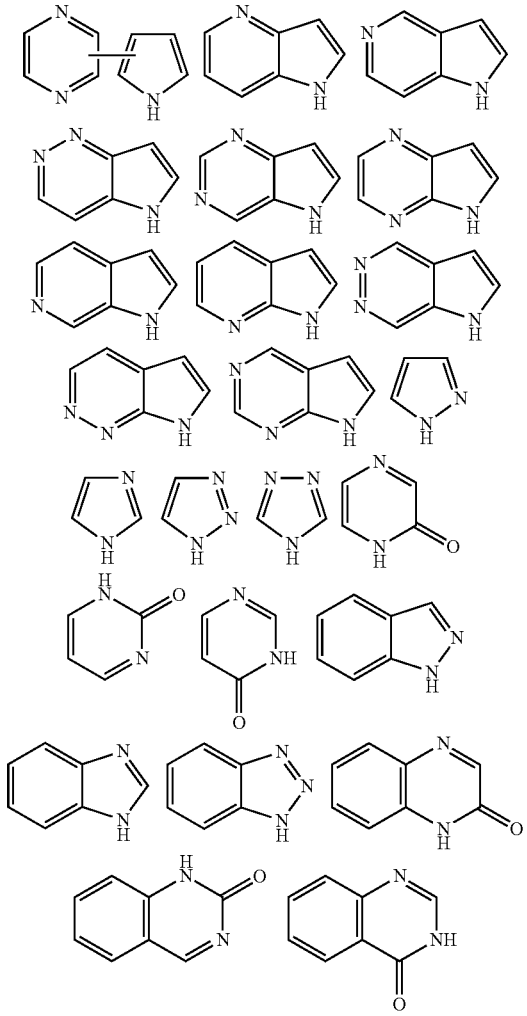

In specific embodiments, preference is given to using optionally at least monosubstituted aromatic dicarboxylic, tricarboxylic or tetracarboxylic acids which can have one, two, three, four or more rings, with each of the rings being able to comprises at least one heteroatom and two or more rings being able to comprise identical or different heteroatoms. For example, preference is given to one-ring dicarboxylic acids, one-ring tricarboxylic acids, one-ring tetracarboxylic acids, two-ring dicarboxylic acids, two-ring tricarboxylic acids, two-ring tetracarboxylic acids, three-ring dicarboxylic acids, three-ring tricarboxylic acids, three-ring tetracarboxylic acids, four-ring dicarboxylic acids, four-ring tricarboxylic acids and/or four-ring tetracarboxylic acids. Suitable heteroatoms are, for example, N, O, S, B, P. In specific embodiments, the heteroatoms are selected from N, S and/or O, Suitable substituents here are, inter alia, —OH, a nitro group, an amino group or an alkyl or alkoxy group.

In specific embodiments, the at least bidentate organic compounds are imidazolates such as 2-methylimidazolate, acetylenedicarboxylic acid (ADC), camphordicarboxylic acid, fumaric acid, succinic acid, benzenedicarboxylic acids such as phthalic acid, isophthalic acid, terephthalic acid (BDC), aminoterephthalic acid, triethylenediamine (TEDA), methylglycinediacetic acid (MGDA), naphthalenedicarboxylic acids (NDC), biphenyldicarboxylic acids such as 4,4'-biphenyldicarboxylic acid (BPDC), pyrazinedicarboxylic acids such as 2,5-pyrazinedicarboxylic acid, bipyridinedicarboxylic acids such as 2,2'-bipyridinedicarboxylic acids such as 2,2'-bipyridine-5,5'-dicarboxylic acid, benzenetricarboxylic acids such as 1,2,3-, 1,2,4-benzenetricarboxylic acid or 1,3,5-benzenetricarboxylic acid (BTC), benzenetetracarboxylic acid, adamantanetetracarboxylic acid (ATC), adamantanedibenzoate (ADB), benzenetribenzoate (BTB), methanetetrabenzoate (MTB), adamantanetetrabenzoate or dihydroxyterephthalic acids such as 2,5-dihydroxyterephthalic acid (DHBDC), tetrahydropyrene-2,7-dicarboxylic acid (HPDC), biphenyltetracarboxylic acid (BPTC), 1,3-bis (4-pyridyl)propane (BPP).

In specific embodiments, preference is given to using, inter alia, 2-methylimidazole, 2-ethylimidazole, phthalic acid, isophthalic acid, terephthalic acid, 2,6-naphthalenedicarboxylic acid, 1,4-naphthalenedicarboxylic acid, 1,5-naphthalene-dicarboxylic acid, 1,2,3-benzenetricarboxylic acid, 1,2,4-benzenetricarboxylic acid, 1,3,5-benzenetricarboxylic acid, 1,2,4,5-benzenetetracarboxylic acid, aminoBDC, TEDA, fumaric acid, biphenyldicarboxylate, 1,5- and 2,6-naphthalenedicarboxylic acid, tert-butylisophthalic acid, dihydroxybenzoic acid, BTB, HPDC, BPTC, BPP.

Apart from these at least bidentate organic compounds, the metal-organic framework can also comprise one or more monodentate ligands and/or one or more at least bidentate ligands which are not derived from a dicarboxylic, tricarboxlic or tetracarboxylic acid.

Apart from these at least bidentate organic compounds, the metal-organic framework can also comprise one or more monodentate iigands.

In specific embodiments, at the at least bidentate organic compounds are formic acid, acetic acid or an aliphatic dicarboxylic or polycarboxylic acid, for example malonic acid, fumaric acid or the like, in particular fumaric acid, or are derived from these.

For the purposes of the present invention, the term "derived" means that the at least one at least bidentate organic compound is present in partially or fully deprotonated form. Furthermore, the term "derived" means that the at least one at least bidentate organic compound can have further substituents. Thus, a dicarboxylic or polycarboxylic acid can have not only the carboxylic acid function but also one or more independent substituents such as amino, hydroxyl, methoxy, halogen or methyl groups. Preference is given to no further substituent being present. For the purposes of the present invention, the term "derived" also means that the carboxylic acid function can be present as a sulfur analogue. Sulfur analogues are —C(═O)SH and its tautomer and —C(S)SH.

Suitable solvents for preparing the metal-organic framework are, inter alia, ethanol, dimethylformamide, toluene, methanol, chlorobenzene, diethylformamide, dimethyl sulfoxide, water, hydrogen peroxide, methylamine, sodium hydroxide solution, N-methylpyrrolidone ether, acetonitrile, benzyl chloride, triethylamine, ethylene glycol and mixtures thereof. Further metal ions, at least bidentate organic compounds and solvents for the preparation of MOFs are described, inter alia, in U.S. Pat. No. 5,648,508 or DE-A 101 11 230.

The pore size of the metal-organic framework can be controlled by selection of the appropriate ligand and/or the at least bidentate organic compound. In general, the larger the organic compound, the larger the pore size. The pore size is preferably from 0.2 nm to 30 nm, particularly preferably in the range from 0.3 nm to 3 nm, based on the crystalline material.

Examples of metal-organic frameworks are given below. In addition to the designation of the framework, the metal and the at least bidentate ligand, the solvent and the cell parameters (angles α, β and γ and the dimensions A, B and C in Å) are also indicated. The latter were determined by X-ray diffraction.

| MOF-n | Constituents molar ratio M + L | Solvents | α | β | γ | a | b | c | Space group |
|---|---|---|---|---|---|---|---|---|---|
| MOF-0 | $Zn(NO_3)_2 \cdot 6H_2O$ $H_3(BTC)$ | ethanol | 90 | 90 | 120 | 16.711 | 16.711 | 14.189 | P6(3)/ Mcm |
| MOF-2 | $Zn(NO_3)_2 \cdot 6H_2O$ (0.246 mmol) $H_2(BDC)$ 0.241 mmol) | DMF toluene | 90 | 102.8 | 90 | 6.718 | 15.49 | 12.43 | P2(1)/n |
| MOF-3 | $Zn(NO_3)_2 \cdot 6H_2O$ (1.89 mmol) $H_2(BDC)$ (1.93 mmol) | DMF MeOH | 99.72 | 111.11 | 108.4 | 9.726 | 9.911 | 10.45 | P-1 |
| MOF-4 | $Zn(NO_3)_2 \cdot 6H_2O$ (1.00 mmol) $H_3(BTC)$ (0.5 mmol) | ethanol | 90 | 90 | 90 | 14.728 | 14.728 | 14.728 | P2(1)3 |
| MOF-5 | $Zn(NO_3)_2 \cdot 6H_2O$ (2.22 mmol) $H_2(BDC)$ (2.17 mmol) | DMF chloro-benzene | 90 | 90 | 90 | 25.669 | 25.669 | 25.669 | Fm-3m |
| MOF-38 | $Zn(NO_3)_2 \cdot 6H_2O$ (0.27 mmol) $H_3(BTC)$ (0.15 mmol) | DMF chloro-benzene | 90 | 90 | 90 | 20.657 | 20.657 | 17.84 | 14cm |
| MOF-31 $Zn(ADC)_2$ | $Zn(NO_3)_2 \cdot 6H_2O$ 0.4 mmol $H_2(ADC)$ 0.8 mmol | ethanol | 90 | 90 | 90 | 10.821 | 10.821 | 10.821 | Pn(−3)m |
| MOF-12 $Zn_2(ATC)$ | $Zn(NO_3)_2 \cdot 6H_2O$ 0.3 mmol $H_4(ATC)$ 0.15 mmol | ethanol | 90 | 90 | 90 | 15.745 | 16.907 | 18.167 | Pbca |

-continued

| MOF-n | Constituents molar ratio M + L | Solvents | α | β | γ | a | b | c | Space group |
|---|---|---|---|---|---|---|---|---|---|
| MOF-20 ZnNDC | $Zn(NO_3)_2 \cdot 6H_2O$ 0.37 mmol $H_2NDC$ 0.36 mmol | DMF chloro-benzene | 90 | 92.13 | 90 | 8.13 | 16.444 | 12.807 | P2(1)/c |
| MOF-37 | $Zn(NO_3)_2 \cdot 6H_2O$ 0.2 mmol $H_2NDC$ 0.2 mmol | DEF chloro-benzene | 72.38 | 83.16 | 84.33 | 9.952 | 11.576 | 15.556 | P-1 |
| MOF-8 $Tb_2$ (ADC) | $Tb(NO_3)_3 \cdot 5H_2O$ 0.10 mmol $H_2ADC$ 0.20 mmol | DMSO MeOH | 90 | 115.7 | 90 | 19.83 | 9.822 | 19.183 | C2/c |
| MOF-9 $Tb_2$ (ADC) | $Tb(NO_3)_3 \cdot 5H_2O$ 0.08 mmol $H_2ADB$ 0.12 mmol | DMSO | 90 | 102.09 | 90 | 27.056 | 16.795 | 28.139 | C2/c |
| MOF-6 | $Tb(NO_3)_3 \cdot 5H_2O$ 0.30 mmol $H_2$ (BDC) 0.30 mmol | DMF MeOH | 90 | 91.28 | 90 | 17.599 | 19.996 | 10.545 | P21/c |
| MOF-7 | $Tb(NO_3)_3 \cdot 5H_2O$ 0.15 mmol $H_2$(BDC) 0.15 mmol | $H_2O$ | 102.3 | 91.12 | 101.5 | 6.142 | 10.069 | 10.096 | P-1 |
| MOF-69A | $Zn(NO_3)_2 \cdot 6H_2O$ 0.083 mmol 4,4'BPDC 0.041 mmol | DEF $H_2O_2$ $MeNH_2$ | 90 | 111.6 | 90 | 23.12 | 20.92 | 12 | C2/c |
| MOF-69B | $Zn(NO_3)_2 \cdot 6H_2O$ 0.083 mmol 2,6-NCD 0.041 mmol | DEF $H_2O_2$ $MeNH_2$ | 90 | 95.3 | 90 | 20.17 | 18.55 | 12.16 | C2/c |
| MOF-11 $Cu_2$(ATC) | $Cu(NO_3)_2 \cdot 2.5H_2O$ 0.47 mmol $H_2ATC$ 0.22 mmol | $H_2O$ | 90 | 93.86 | 90 | 12.987 | 11.22 | 11.336 | C2/c |
| MOF-11 $Cu_2$(ATC) dehydr. | | | 90 | 90 | 90 | 8.4671 | 8.4671 | 14.44 | P42/ mmc |
| MOF-14 $Cu_3$ (BTB) | $Cu(NO_3)_2 \cdot 2.5H_2O$ 0.28 mmol $H_3BTB$ 0.052 mmol | $H_2O$ DMF EtOH | 90 | 90 | 90 | 26.946 | 26.946 | 26.946 | Im-3 |
| MOF-32 Cd(ATC) | $Cd(NO_3)_2 \cdot 4H_2O$ 0.24 mmol $H_4ATC$ 0.10 mmol | $H_2O$ NaOH | 90 | 90 | 90 | 13.468 | 13.468 | 13.468 | P(−4)3m |
| MOF-33 $Zn_2$ (ATB) | $ZnCl_2$ 0.15 mmol $H_4ATB$ 0.02 mmol | $H_2O$ DMF EtOH | 90 | 90 | 90 | 19.561 | 15.255 | 23.404 | Imma |
| MOF-34 Ni(ATC) | $Ni(NO_3)_2 \cdot 6H_2O$ 0.24 mmol $H_4ATC$ 0.10 mmol | $H_2O$ NaOH | 90 | 90 | 90 | 10.066 | 11.163 | 19.201 | $P2_12_12_1$ |
| MOF-36 $Zn_2$ (MTB) | $Zn(NO_3)_2 \cdot 4H_2O$ 0.20 mmol $H_4MTB$ 0.04 mmol | $H_2O$ DMF | 90 | 90 | 90 | 15.745 | 16.907 | 18.167 | Pbca |
| MOF-39 $Zn_3O$(HBTB) | $Zn(NO_3)_2$ $4H_2O$ 0.27 mmol $H_3BTB$ 0.07 mmol | $H_2O$ DMF EtOH | 90 | 90 | 90 | 17.158 | 21.591 | 25.308 | Pnma |
| NO305 | $FeCl_2 \cdot 4H_2O$ 5.03 mmol formic acid 86.90 mmol | DMF | 90 | 90 | 120 | 8.2692 | 8.2692 | 63.566 | R-3c |
| NO306A | $FeCl_2 \cdot 4H_2O$ 5.03 mmol formic acid. 86.90 mmol | DEF | 90 | 90 | 90 | 9.9364 | 18.374 | 18.374 | Pbcn |
| NO29 MOF-0 similar | $Mn(Ac)_2 \cdot 4H_2O$ 0.46 mmol $H_3BTC$ 0.69 mmol | DMF | 120 | 90 | 90 | 14.16 | 33.521 | 33.521 | P-1 |

-continued

| MOF-n | Constituents molar ratio M + L | Solvents | α | β | γ | a | b | c | Space group |
|---|---|---|---|---|---|---|---|---|---|
| BPR48 A2 | $Zn(NO_3)_2$ $6H_2O$ 0.012 mmol $H_2BDC$ 0.012 mmol | DMSO toluene | 90 | 90 | 90 | 14.5 | 17.04 | 18.02 | Pbca |
| BPR69 B1 | $Cd(NO_3)_2$ $4H_2O$ 0.0212 mmol $H_2BDC$ 0.0428 mmol | DMSO | 90 | 98.76 | 90 | 14.16 | 15.72 | 17.66 | Cc |
| BPR92 A2 | $Co(NO_3)_2$•$6H_2O$ 0.018 mmol $H_2BDC$ 0.018 mmol | NMP | 106.3 | 107.63 | 107.2 | 7.5308 | 10.942 | 11.025 | P1 |
| BPR95 C5 | $Cd(NO_3)_2$ $4H_2O$ 0.012 mmol $H_2BDC$ 0.36 mmol | NMP | 90 | 112.8 | 90 | 14.460 | 11.085 | 15.829 | P2(1)/n |
| $CuC_6H_4O_6$ | $Cu(NO_3)_2$•$2.5H_2O$ 0.370 mmol $H_2BDC(OH)_2$ 0.37 mmol | DMF chloro-benzene | 90 | 105.29 | 90 | 15.259 | 14.816 | 14.13 | P2(1)/c |
| M(BTC) MOF-0 similar | $Co(SO_4)$ $H_2O$ 0.055 mmol $H_3BTC$ 0.037 mmol | DMF | | like MOF-0 | | | | | |
| $Tb(C_6H_4O_6)$ | $Tb(NO_3)_3$•$5H_2O$ 0.370 mmol $H_2(C_6H_4O_6)$ 0.56 mmol | DMF chloro-benzene | 104.6 | 107.9 | 97.147 | 10.491 | 10.981 | 12.541 | P-1 |
| Zn $(C_2O_4)$ | $ZnCl_2$ 0.370 mmol oxalic acid 0.37 mmol | DMF chloro-benzene | 90 | 120 | 90 | 9.4168 | 9.4168 | 8.464 | P(−3)1m |
| Co(CHO) | $Co(NO_3)_2$•$5H_2O$ 0.043 mmol formic acid 1.60 mmol | DMF | 90 | 91.32 | 90 | 11.328 | 10.049 | 14.854 | P2(1)/n |
| Cd(CHO) | $Cd(NO_3)_2$•$4H_2O$ 0.185 mmol formic acid 0.185 mmol | DMF | 90 | 120 | 90 | 8.5168 | 8.5168 | 22.674 | R-3c |
| $Cu(C_3H_2O_4)$ | $Cu(NO_3)_2$•$2.5H_2O$ 0.043 mmol malonic acid 0.192 mmol | DMF | 90 | 90 | 90 | 8.366 | 8.366 | 11.919 | P43 |
| $Zn_6$ $(NDC)_5$ MOF-48 | $Zn(NO_3)_2$•$6H_2O$ 0.097 mmol 14 NDC 0.069 mmol | DMF chloro-benzene $H_2O_2$ | 90 | 95.902 | 90 | 19.504 | 16.482 | 14.64 | C2/m |
| MOF-47 | $Zn(NO_3)_2$ $6H_2O$ 0.185 mmol $H_2(BDC[CH_3]_4)$ 0.185 mmol | DMF chloro-benzene $H_2O_2$ | 90 | 92.55 | 90 | 11.303 | 16.029 | 17.535 | P2(1)/c |
| MO25 | $Cu(NO_3)_2$•$2.5H_2O$ 0.084 mmol BPhDC 0.085 mmol | DMF | 90 | 112.0 | 90 | 23.880 | 16.834 | 18.389 | P2(1)/c |
| Cu-Thio | $Cu(NO_3)_2$•$2.5H_2O$ 0.084 mmol thiophene dicarboxylic acid 0.085 mmol | DEF | 90 | 113.6 | 90 | 15.4747 | 14.514 | 14.032 | P2(1)/c |
| ClBDC1 | $Cu(NO_3)_2$•$2.5H_2O$ 0.084 mmol $H_2(BDCCl_2)$ 0.085 mmol | DMF | 90 | 105.6 | 90 | 14.911 | 15.622 | 18.413 | C2/c |
| MOF-101 | $Cu(NO_3)_2$•$2.5H_2O$ 0.084 mmol BrBDC 0.085 mmol | DMF | 90 | 90 | 90 | 21.607 | 20.607 | 20.073 | Fm3m |
| $Zn_3(BTC)_2$ | $ZnCl_2$ 0.033 mmol $H_3BTC$ 0.033 mmol | DMF EtOH Base added | 90 | 90 | 90 | 26.572 | 26.572 | 26.572 | Fm-3m |

-continued

| MOF-n | Constituents molar ratio M + L | Solvents | α | β | γ | a | b | c | Space group |
|---|---|---|---|---|---|---|---|---|---|
| MOF-j | $Co(CH_3CO_2)_2 \cdot 4H_2O$ (1.65 mmol) $H_3$(BZC) (0.95 mmol) | $H_2O$ | 90 | 112.0 | 90 | 17.482 | 12.963 | 6.559 | C2 |
| MOF-n | $Zn(NO_3)_2 \cdot 6H_2O$ $H_3$ (BTC) | ethanol | 90 | 90 | 120 | 16.711 | 16.711 | 14.189 | P6(3)/mcm |
| PbBDC | $Pb(NO_3)_2$ (0.181 mmol) $H_2$(BDC) (0.181 mmol) | DMF ethanol | 90 | 102.7 | 90 | 8.3639 | 17.991 | 9.9617 | P2(1)/n |
| Znhex | $Zn(NO_3)_2 \cdot 6H_2O$ (0.171 mmol) $H_3$BTB (0.114 mmol) | DMF p-xylene ethanol | 90 | 90 | 120 | 37.1165 | 37.117 | 30.019 | P3(1)c |
| AS16 | $FeBr_2$ 0.927 mmol $H_2$(BDC) 0.927 mmol | DMF anhydr. | 90 | 90.13 | 90 | 7.2595 | 8.7894 | 19.484 | P2(1)c |
| AS27-2 | $FeBr_2$ 0.927 mmol $H_3$(BDC) 0.464 mmol | DMF anhydr. | 90 | 90 | 90 | 26.735 | 26.735 | 26.735 | Fm3m |
| AS32 | $FeCl_3$ 1.23 mmol $H_2$(BDC) 1.23 mmol | DMF anhydr. ethanol | 90 | 90 | 120 | 12.535 | 12.535 | 18.479 | P6(2)c |
| AS54-3 | $FeBr_2$ 0.927 BPDC 0.927 mmol | DMF anhydr. n-propanol | 90 | 109.98 | 90 | 12.019 | 15.286 | 14.399 | C2 |
| AS61-4 | $FeBr_2$ 0.927 mmol m-BDC 0.927 mmol | anhydrous pyridine | 90 | 90 | 120 | 13.017 | 13.017 | 14.896 | P6(2)c |
| AS68-7 | $FeBr_2$ 0.927 mmol m-BDC 1.204 mmol | DMF anhydr. pyridine | 90 | 90 | 90 | 18.3407 | 10.036 | 18.039 | $Pca2_1$ |
| Zn(ADC) | $Zn(NO_3)_2 \cdot 6H_2O$ 0.37 mmol $H_2$(ADC) 0.36 mmol | DMF chloro-benzene | 90 | 99.85 | 90 | 16.764 | 9.349 | 9.635 | C2/c |
| MOF-12 $Zn_2$ (ATC) | $Zn(NO_3)_2 \cdot 6H_2O$ 0.30 mmol $H_4$(ATC) 0.15 mmol | ethanol | 90 | 90 | 90 | 15.745 | 16.907 | 18.167 | Pbca |
| MOF-20 ZnNDC | $Zn(NO_3)_2 \cdot 6H_2O$ 0.37 mmol $H_2$NDC 0.36 mmol | DMF chloro-benzene | 90 | 92.13 | 90 | 8.13 | 16.444 | 12.807 | P2(1)/c |
| MOF-37 | $Zn(NO_3)_2 \cdot 6H_2O$ 0.20 mmol $H_2$NDC 0.20 mmol | DEF chloro-benzene | 72.38 | 83.16 | 84.33 | 9.952 | 11.576 | 15.556 | P-1 |
| Zn(NDC) (DMSO) | $Zn(NO_3)_2 \cdot 6H_2O$ $H_2$NDC | DMSO | 68.08 | 75.33 | 88.31 | 8.631 | 10.207 | 13.114 | P-1 |
| Zn(NDC) | $Zn(NO_3)_2 \cdot 6H_2O$ $H_2$NDC | | 90 | 99.2 | 90 | 19.289 | 17.628 | 15.052 | C2/c |
| Zn(HPDC) | $Zn(NO_3)_2 \cdot 4H_2O$ 0.23 mmol $H_2$(HPDC) 0.05 mmol | DMF $H_2O$ | 107.9 | 105.06 | 94.4 | 8.326 | 12.085 | 13.767 | P-1 |
| Co(HPDC) | $Co(NO_3)_2 \cdot 6H_2O$ 0.21 mmol $H_2$ (HPDC) 0.06 mmol | DMF $H_2O$/ ethanol | 90 | 97.69 | 90 | 29.677 | 9.63 | 7.981 | C2/c |
| $Zn_3$(PDC)2.5 | $Zn(NO_3)_2 \cdot 4H_2O$ 0.17 mmol $H_2$(HPDC) 0.05 mmol | DMF/ ClBz $H_20$/ TEA | 79.34 | 80.8 | 85.83 | 8.564 | 14.046 | 26.428 | P-1 |
| $Cd_2$ (TPDC)2 | $Cd(NO_3)_2 \cdot 4H_2O$ 0.06 mmol $H_2$(HPDC) 0.06 mmol | methanol/ CHP $H_2O$ | 70.59 | 72.75 | 87.14 | 10.102 | 14.412 | 14.964 | P-1 |
| Tb(PDC)1.5 | $Tb(NO_3)_3 \cdot 5H_2O$ 0.21 mmol | DMF $H_2O$/ | 109.8 | 103.61 | 100.14 | 9.829 | 12.11 | 14.628 | P-1 |

-continued

| MOF-n | Constituents molar ratio M + L | Solvents | α | β | γ | a | b | c | Space group |
|---|---|---|---|---|---|---|---|---|---|
| | $H_2$(PDC) 0.034 mmol | ethanol | | | | | | | |
| ZnDBP | $Zn(NO_3)_2 \cdot 6H_2O$ 0.05 mmol dibenzyl phosphate 0.10 mmol | MeOH | 90 | 93.67 | 90 | 9.254 | 10.762 | 27.93 | P2/n |
| $Zn_3$(BPDC) | $ZnBr_2$ 0.021 mmol 4,4'BPDC 0.005 mmol | DMF | 90 | 102.76 | 90 | 11.49 | 14.79 | 19.18 | P21/n |
| CdBDC | $Cd(NO_3)_2 \cdot 4H_2O$ 0.100 mmol $H_2$(BDC) 0.401 mmol | DMF $Na_2SiO_3$ (aq) | 90 | 95.85 | 90 | 11.2 | 11.11 | 16.71 | P21/n |
| Cd-mBDC | $Cd(NO_3)_2 \cdot 4H_2O$ 0.009 mmol $H_2$(mBDC) 0.018 mmol | DMF $MeNH_2$ | 90 | 101.1 | 90 | 13.69 | 18.25 | 14.91 | C2/c |
| $Zn_4$OBNDC | $Zn(NO_3)_2 \cdot 6H_2O$ 0.041 mmol BNDC | DEF $MeNH_2$ $H_2O_2$ | 90 | 90 | 90 | 22.35 | 26.05 | 59.56 | Fmmm |
| Eu(TCA) | $Eu(NO_3)_3 \cdot 6H_2O$ 0.14 mmol TCA 0.026 mmol | DMF chloro-benzene | 90 | 90 | 90 | 23.325 | 23.325 | 23.325 | Pm-3n |
| Tb(TCA) | $Tb(NO_3)_3 \cdot 6H_2O$ 0.069 mmol TCA 0.026 mmol | DMF chloro-benzene | 90 | 90 | 90 | 23.272 | 23.272 | 23.372 | Pm-3n |
| Formate | $Ce(NO_3)_3 \cdot 6H_2O$ 0.138 mmol formic acid 0.43 mmol | $H_2O$ ethanol | 90 | 90 | 120 | 10.668 | 10.667 | 4.107 | R-3m |
| | $FeCl_2 \cdot 4H_2O$ 5.03 mmol formic acid 86.90 mmol | DMF | 90 | 90 | 120 | 8.2692 | 8.2692 | 63.566 | R-3c |
| | $FeCl_2 \cdot 4H_2O$ 5.03 mmol formic acid 86.90 mmol | DEF | 90 | 90 | 90 | 9.9364 | 18.374 | 18.374 | Pbcn |
| | $FeCl_2 \cdot 4H_2O$ 5.03 mmol formic acid 86.90 mmol | DEF | 90 | 90 | 90 | 8.335 | 8.335 | 13.34 | P-31c |
| NO330 | $FeCl_2 \cdot 4H_2O$ 0.50 mmol formic acid 8.69 mmol | formamide | 90 | 90 | 90 | 8.7749 | 11.655 | 8.3297 | Pnna |
| NO332 | $FeCl_2 \cdot 4H_2O$ 0.50 mmol formic acid 8.69 mmol | DIP | 90 | 90 | 90 | 10.0313 | 18.808 | 18.355 | Pbcn |
| NO333 | $FeCl_2 \cdot 4H_2O$ 0.50 mmol formic acid 8.69 mmol | DBF | 90 | 90 | 90 | 45.2754 | 23.861 | 12.441 | Cmcm |
| NO335 | $FeCl_2 \cdot 4H_2O$ 0.50 mmol formic acid 8.69 mmol | CHF | 90 | 91.372 | 90 | 11.5964 | 10.187 | 14.945 | P21/n |
| NO336 | $FeCl_2 \cdot 4H_2O$ 0.50 mmol formic acid 8.69 mmol | MFA | 90 | 90 | 90 | 11.7945 | 48.843 | 8.4136 | Pbcm |
| NO13 | $Mn(Ac)_2 \cdot 4H_2O$ 0.46 mmol benzoic acid 0.92 mmol bipyridine 0.46 mmol | ethanol | 90 | 90 | 90 | 18.66 | 11.762 | 9.418 | Pbcn |
| NO29 MOF-0 similar | $Mn(Ac)_2 \cdot 4H_2O$ 0.46 mmol $H_3$BTC 0.69 mmol | DMF | 120 | 90 | 90 | 14.16 | 33.521 | 33.521 | P-1 |

-continued

| MOF-n | Constituents molar ratio M + L | Solvents | α | β | γ | a | b | c | Space group |
|---|---|---|---|---|---|---|---|---|---|
| $Mn(hfac)_2$ ($O_2CC_6H_5$) | $Mn(Ac)_2$•$4H_2O$ 0.46 mmol Hfac 0.92 mmol bipyridine 0.46 mmol | ether | 90 | 95.32 | 90 | 9.572 | 17.162 | 14.041 | C2/c |
| BPR43G2 | $Zn(NO_3)_2$•$6H_2O$ 0.0288 mmol $H_2BDC$ 0.0072 mmol | DMF $CH_3CN$ | 90 | 91.37 | 90 | 17.96 | 6.38 | 7.19 | C2/c |
| BPR48A2 | $Zn(NO_3)_2$ $6H_2O$ 0.012 mmol $H_2BDC$ 0.012 mmol | DMSO toluene | 90 | 90 | 90 | 14.5 | 17.04 | 18.02 | Pbca |
| BPR49B1 | $Zn(NO_3)_2$ $6H_2O$ 0.024 mmol $H_2BDC$ 0.048 mmol | DMSO methanol | 90 | 91.172 | 90 | 33.181 | 9.824 | 17.884 | C2/c |
| BPR56E1 | $Zn(NO_3)_2$ $6H_2O$ 0.012 mmol $H_2BDC$ 0.024 mmol | DMSO n-propanol | 90 | 90.096 | 90 | 14.5873 | 14.153 | 17.183 | P2(1)/n |
| BPR68D10 | $Zn(NO_3)_2$ $6H_2O$ 0.0016 mmol $H_3BTC$ 0.0064 mmol | DMSO benzene | 90 | 95.316 | 90 | 10.0627 | 10.17 | 16.413 | P2(1)/c |
| BPR69B1 | $Cd(NO_3)_2$ $4H_2O$ 0.0212 mmol $H_2BDC$ 0.0428 mmol | DMSO | 90 | 98.76 | 90 | 14.16 | 15.72 | 17.66 | Cc |
| BPR73E4 | $Cd(NO_3)_2$ $4H_2O$ 0.006 mmol $H_2BDC$ 0.003 mmol | DMSO toluene | 90 | 92.324 | 90 | 8.7231 | 7.0568 | 18.438 | P2(1)/n |
| BPR76D5 | $Zn(NO_3)_2$ $6H_2O$ 0.0009 mmol $H_2BzPDC$ 0.0036 mmol | DMSO | 90 | 104.17 | 90 | 14.4191 | 6.2599 | 7.0611 | Pc |
| BPR80B5 | $Cd(NO_3)_2$•$4H_2O$ 0.018 mmol $H_2BDC$ 0.036 mmol | DMF | 90 | 115.11 | 90 | 28.049 | 9.184 | 17.837 | C2/c |
| BPR80H5 | $Cd(NO_3)_2$ $4H_2O$ 0.027 mmol $H_2BDC$ 0.027 mmol | DMF | 90 | 119.06 | 90 | 11.4746 | 6.2151 | 17.268 | P2/c |
| BPR82C6 | $Cd(NO_3)_2$ $4H_2O$ 0.0068 mmol $H_2BDC$ 0.202 mmol | DMF | 90 | 90 | 90 | 9.7721 | 21.142 | 27.77 | Fdd2 |
| BPR86C3 | $Co(NO_3)_2$ $6H_2O$ 0.0025 mmol $H_2BDC$ 0.075 mmol | DMF | 90 | 90 | 90 | 18.3449 | 10.031 | 17.983 | Pca2(1) |
| BPR86H6 | $Cd(NO_3)_2$•$6H_2O$ 0.010 mmol $H_2BDC$ 0.010 mmol | DMF | 80.98 | 89.69 | 83.412 | 9.8752 | 10.263 | 15.362 | P-1 |
| | $Co(NO_3)_2$ $6H_2O$ | NMP | 106.3 | 107.63 | 107.2 | 7.5308 | 10.942 | 11.025 | P1 |
| BPR95A2 | $Zn(NO_3)_2$ $6H_2O$ 0.012 mmol $H_2BDC$ 0.012 mmol | NMP | 90 | 102.9 | 90 | 7.4502 | 13.767 | 12.713 | P2(1)/c |
| $CuC_6F_4O_4$ | $Cu(NO_3)_2$•$2.5H_2O$ 0.370 mmol $H_2BDC(OH)_2$ 0.37 mmol | DMF chloro-benzene | 90 | 98.834 | 90 | 10.9675 | 24.43 | 22.553 | P2(1)/n |
| Fe Formic | $FeCl_2$•$4H_2O$ 0.370 mmol formic acid 0.37 mmol | DMF | 90 | 91.543 | 90 | 11.495 | 9.963 | 14.48 | P2(1)/n |
| Mg Formic | $Mg(NO_3)_2$•$6H_2O$ 0.370 mmol formic acid 0.37 mmol | DMF | 90 | 91.359 | 90 | 11.383 | 9.932 | 14.656 | P2(1)/n |

-continued

| MOF-n | Constituents molar ratio M + L | Solvents | α | β | γ | a | b | c | Space group |
|---|---|---|---|---|---|---|---|---|---|
| $MgC_6H_4O_6$ | $Mg(NO_3)_2$•$6H_2O$ 0.370 mmol $H_2BDC(OH)_2$ 0.37 mmol | DMF | 90 | 96.624 | 90 | 17.245 | 9.943 | 9.273 | C2/c |
| Zn $C_2H_4BDC$ MOF-38 | $ZnCl_2$ 0.44 mmol CBBDC 0.261 mmol | DMF | 90 | 94.714 | 90 | 7.3386 | 16.834 | 12.52 | P2(1)/n |
| MOF-49 | $ZnCl_2$ 0.44 mmol m-BDC 0.261 mmol | DMF $CH_3CN$ | 90 | 93.459 | 90 | 13.509 | 11.984 | 27.039 | P2/c |
| MOF-26 | $Cu(NO_3)_2$•$5H_2O$ 0.084 mmol DCPE 0.085 mmol | DMF | 90 | 95.607 | 90 | 20.8797 | 16.017 | 26.176 | P2(1)/n |
| MOF-112 | $Cu(NO_3)_2$•$2.5H_2O$ 0.084 mmol o-Br-m-BDC 0.085 mmol | DMF ethanol | 90 | 107.49 | 90 | 29.3241 | 21.297 | 18.069 | C2/c |
| MOF-109 | $Cu(NO_3)_2$•$2.5H_2O$ 0.084 mmol KDB 0.085 mmol | DMF | 90 | 111.98 | 90 | 23.8801 | 16.834 | 18.389 | P2(1)/c |
| MOF-111 | $Cu(NO_3)_2$•$2.5H_2O$ 0.084 mmol o-BrBDC 0.085 mmol | DMF ethanol | 90 | 102.16 | 90 | 10.6767 | 18.781 | 21.052 | C2/c |
| MOF-110 | $Cu(NO_3)_2$•$2.5H_2O$ 0.084 mmol thiophene dicarboxylic acid 0.085 mmol | DMF | 90 | 90 | 120 | 20.0652 | 20.065 | 20.747 | R-3/m |
| MOF-107 | $Cu(NO_3)_2$•$2.5H_2O$ 0.084 mmol thiophene dicarboxylic acid. 0.085 mmol | DEF | 104.8 | 97.075 | 95.206 | 11.032 | 18.067 | 18.452 | P-1 |
| MOF-108 | Cu(NO3)2•2.5H2O 0.084 mmol thiophene dicarboxylic acid 0.085 mmol | DBF/ methanol | 90 | 113.63 | 90 | 15.4747 | 14.514 | 14.032 | C2/c |
| MOF-102 | Cu(NO3)2•2.5H2O 0.084 mmol H2(BDCCl2) 0.085 mmol | DMF | 91.63 | 106.24 | 112.01 | 9.3845 | 10.794 | 10.831 | P-1 |
| Clbdc1 | Cu(NO3)2•2.5H2O 0.084 mmol H2(BDCCl2) 0.085 mmol | DEF | 90 | 105.56 | 90 | 14.911 | 15.622 | 18.413 | P-1 |
| Cu(NMOP) | Cu(NO3)2•2.5H2O 0.084 mmol NBDC 0.085 mmol | DMF | 90 | 102.37 | 90 | 14.9238 | 18.727 | 15.529 | P2(1)/m |
| Tb(BTC) | Tb(NO3)3•5H2O 0.033 mmol H3BTC 0.033 mmol | DMF | 90 | 106.02 | 90 | 18.6986 | 11.368 | 19.721 | |
| Zn3(BTC)2 Honk | ZnCl2 0.033 mmol H3BTC 0.033 mmol | DMF ethanol | 90 | 90 | 90 | 26.572 | 26.572 | 26.572 | Fm-3m |
| Zn4O(NDC) | Zn(NO3)2•4H2O 0.066 mmol 14NDC 0.066 mmol | DMF ethanol | 90 | 90 | 90 | 41.5594 | 18.818 | 17.574 | aba2 |
| CdTDC | Cd(NO3)2•4H2O 0.014 mmol thiophene 0.040 mmol DABCO 0.020 mmol | DMF H2O | 90 | 90 | 90 | 12.173 | 10.485 | 7.33 | Pmma |
| IRMOF-2 | Zn(NO3)2•4H2O 0.160 mmol | DEF | 90 | 90 | 90 | 25.772 | 25.772 | 25.772 | Fm-3m |

-continued

| MOF-n | Constituents molar ratio M + L | Solvents | α | β | γ | a | b | c | Space group |
|---|---|---|---|---|---|---|---|---|---|
| | o-Br-BDC 0.60 mmol | | | | | | | | |
| IRMOF-3 | Zn(NO3)2•4H2O 0.20 mmol H2N-BDC 0.60 mmol | DEF ethanol | 90 | 90 | 90 | 25.747 | 25.747 | 25.747 | Fm-3m |
| IRMOF-4 | Zn(NO3)2•4H2O 0.11 mmol [C3H7O]2-BDC 0.48 mmol | DEF | 90 | 90 | 90 | 25.849 | 25.849 | 25.849 | Fm-3m |
| IRMOF-5 | Zn(NO3)2•4H2O 0.13 mmol [C5H11O]2-BDC 0.50 mmol | DEF | 90 | 90 | 90 | 12.882 | 12.882 | 12.882 | Pm-3m |
| IRMOF-6 | Zn(NO3)2•4H2O 0.20 mmol [C2H4]-BDC 0.60 mmol | DEF | 90 | 90 | 90 | 25.842 | 25.842 | 25.842 | Fm-3m |
| IRMOF-7 | Zn(NO3)2•4H2O 0.07 mmol 1,4NDC 0.20 mmol | DEF | 90 | 90 | 90 | 12.914 | 12.914 | 12.914 | Pm-3m |
| IRMOF-8 | Zn(NO3)2•4H2O 0.55 mmol 2,6NDC 0.42 mmol | DEF | 90 | 90 | 90 | 30.092 | 30.092 | 30.092 | Fm-3m |
| IRMOF-9 | Zn(NO3)2•4H2O 0.05 mmol BPDC 0.42 mmol | DEF | 90 | 90 | 90 | 17.147 | 23.322 | 25.255 | Pnnm |
| IRMOF-10 | Zn(NO3)2•4H2O 0.02 mmol BPDC 0.012 mmol | DEF | 90 | 90 | 90 | 34.281 | 34.281 | 34.281 | Fm-3m |
| IRMOF-11 | Zn(NO3)2•4H2O 0.05 mmol HPDC 0.20 mmol | DEF | 90 | 90 | 90 | 24.822 | 24.822 | 56.734 | R-3m |
| IRMOF-12 | Zn(NO3)2•4H2O 0.017 mmol HPDC 0.12 mmol | DEF | 90 | 90 | 90 | 34.281 | 34.281 | 34.281 | Fm-3m |
| IRMOF-13 | $Zn(NO_3)_2$•$4H_2O$ 0.048 mmol PDC 0.31 mmol | DEF | 90 | 90 | 90 | 24.822 | 24.822 | 56.734 | R-3m |
| IRMOF-14 | $Zn(NO_3)_2$•$4H_2O$ 0.17 mmol PDC 0.12 mmol | DEF | 90 | 90 | 90 | 34.381 | 34.381 | 34.381 | Fm-3m |
| IRMOF-15 | $Zn(NO_3)_2$•$4H_2O$ 0.063 mmol TPDC 0.025 mmol | DEF | 90 | 90 | 90 | 21.459 | 21.459 | 21.459 | Im-3m |
| IRMOF-16 | $Zn(NO_3)_2$•$4H_2O$ 0.0126 mmol TPDC 0.05 mmol | DEF NMP | 90 | 90 | 90 | 21.49 | 21.49 | 21.49 | Pm-3m |

ADC acetylenedicarboxylic acid
NDC naphthalenedicarboxylic acid
BDC benzenedicarboxylic acid
ATC adamantanetetracarboxylic acid
BTC benzenetricarboxylic acid
BTB benzenetribenzoic acid
MTB methanetetrabenzoic acid
ATB adamantanetetrabenzoic acid
ADB adamantanedibenzoic acid Further metal-organic frameworks are MOF-2 to 4, MOF-9, MOF-31 to 36, MOF-39, MOF-69 to 80, MOF103 to 106, MOF-122, MOF-125, MOF-150, MOF-177, MOF-178, MOF-235, MOF-236, MOF-500, MOF-501, MOF-502, MOF-505, IRMOF-1, IRMOF-61, IRMOP-13, IRMOP-51, MIL-17, MIL-45, MIL-47, MIL-53, MIL-59, MIL-60, MIL-61, MIL-63, MIL-68, MIL-79, MIL-80, MIL-83, MIL-85, CPL-1 to 2, SZL-1, which are described in the literature.

Particularly preferred metal-organic frameworks are MIL-53, Zn-tBu-isophthalic acid, Al-BDC, MOF-5, MOF-177, MOF-505, IRMOF-8, IRMOF-11, Cu-BTC, Al-NDC, Al-aminoBDC, Cu-BDC-TEDA, Zn-BDC-TEDA, Al-BTC, Cu- BTC, Al-NDC, Mg-NDC, Al-fumarate, Zn-2-methylimidazolate, Zn-2-aminoimidazolate, Cu-biphenyldicarboxylate-TEDA, MOF-74, Cu-BPP, Sc-terephthalate. Greater preference is given to Sc-terephthalate, Al-BDC and Al-BTC. In particular, however, preference is given to Mg-formate, Mg-acetate and mixtures thereof because of their environmental friendliness. Aluminum-fumarate is particularly preferred.

In specific embodiments, the layer of the porous metal-organic framework has a mass in the range from 0.1 g/m$^2$ to 100 g/m$^2$, more preferably from 1 g/m$^2$ to 80 g/m$^2$, even more preferably from 3 g/m$^2$ to 50 g/m$^2$.

Without intending to limit the invention in any manner, embodiments will be more fully described by the following examples.

EXAMPLES

The following examples indicate various methods of coating filter paper with aluminum-fumarate MOF by means of direct synthesis.

For all examples, two solutions were produced as described below:

Solution 1: Deionized water (72.7 g) was placed in a vessel and $Al_2(SO_4)_3 \times 18H_2O$ (16.9 g, 25.5 mmol) was dissolved therein with stirring.

Solution 2: Deionized water (87.3 g) was placed in a vessel and NaOH (6.1 g, 152.7 mmol) was dissolved therein with stirring. Fumaric acid (5.9 g, 50.9 mmol) was subsequently added while stirring and the mixture was stirred until a clear solution was formed.

For example 1, filters from Macherey-Nagel (d=150 mm) were used. Filter papers from Schleicher & Schuell (d=90-110 mm) were used for example 2. The surface area of the untreated filter papers is ~1-2 m$^2$/g (specific surface area determined by the Langmuir method (LSA)). The surface areas of the coated papers were determined using a small sample of the filters (~100 mg).

In all examples, room temperature is 22° C.

Example 1

Coating of Filter Papers by Spraying-on the Solutions in a Rotating Spraying Drum at Room Temperature Experimental Method:

The filter paper was fixed in the spraying drum by means of adhesive tape and sprayed with solution 1 by means of a pump having a spray head at room temperature and rotation of the drum. After brief drying or in the moist state, solution 2 was sprayed on at room temperature by means of the pump. The filter paper was subsequently dried at room temperature in a jet of compressed air in the rotating drum. Uniform coating with a few flakes at the edge was obtained. The increase in mass of the filters was 1.2-2.3 g. The dried papers were washed 4 times with 10 ml each time of $H_2O$ on a suction filter under a slight water pump vacuum and dried again at room temperature. The filters obtained were activated at 150° C. in a vacuum drying oven for 16 hours. XRD analysis of a selected sample displayed, in addition to theta cellulose, a weak peak at 10 2-theta which can be assigned to the aluminum-fumarate MOF. The corresponding surface area was 51 m$^2$/g LSA.

Example 2

Coating of Filter Paper by Simultaneous Spraying-on of the Solutions 1 and 2

Experimental Method:

The filter paper was suspended and simultaneously sprayed with up to 1 ml of the two solutions (Eco-Spray sprayer and Desaga SG-1 sprayer). The treated filter paper was dried in air at room temperature while suspended. Homogeneous layers having a few small flakes were obtained. The increasing mass of the filters was 80-290 mg. The paper was subsequently washed 4 times with 10 ml each time of $H_2O$ and dried at 100° C. in a convection drying oven for 16 hours. 31-279 mg were then detected on the filter papers. This corresponds to from 4.9 to 42 g/m$^2$. XRD analysis of a selected sample displayed, in addition to theta cellulose, a strong peak at 10 2-theta (crystallinity ~3000) which can be assigned to the aluminum-fumarate MOF.

Example 3

Coating of Further Support Surfaces

10×10 cm pieces of a teatowel (90% cotton, 10% linen) A, a cotton glove B, cellulose cloths (Zewa®) C, bandaging waste (viscose) D and Basotect E (melamine resin foam) were treated in the same way as the filter paper in example 2. The mass taken up after spraying and drying was 770-500 mg. After washing of the samples A to D with water and subsequent drying at room temperature, coatings of 440-580 mg were obtained. This corresponds to from 4.4 to 5.8 g/m$^2$. Analysis of all samples displayed, in addition to the signals of the respective material, a peak at 10° (2-theta), which can be assigned to the aluminum-fumarate MOF. The surface areas of the treated materials were 17-22 m$^2$/g LSA.

One skilled in the art will recognize that various modifications and variations can be made to the present invention without departing from the spirit or scope of the invention. It is also noted that these materials can be synthesized using a range of temperatures and reaction times. Thus, it is intended that the present invention cover modifications and variations of this invention provided they come within the scope of the appended claims and their equivalents.

What is claimed is:

1. A process for coating at least part of a surface of a support with a porous metal-organic framework comprising at least one at least bidentate organic compound coordinated to at least one metal ion, which process comprises the steps:

(a) spraying of the at least one part of the support surface with a first solution comprising the at least one metal ion;

(b) spraying of the at least one part of the support surface with a second solution comprising the at least one at least bidentate organic compound, wherein step (b) is carried out before, after or simultaneously with step (a), to form a layer of the porous metal-organic framework.

2. The process according to claim 1, wherein the layer is dried.

3. The process according to claim 2, wherein the layer is dried at at least 150° C.

4. The process according to claim 1, wherein the spraying with the first, the second or with both solutions is carried out in a spraying drum.

5. The process according to claim 1, wherein the first, the second or both solutions are at room temperature.

6. The process according to claim 1, wherein the first, the second or both solutions are aqueous solutions.

7. The process according to claim 1, wherein the support surface is a fibrous or foam surface.

8. The process according to claim 1, wherein the at least one metal ion is selected from the group of metals consisting of Mg, Ca, Al and Zn.

9. The process according to claim 1, wherein the at least one at least bidentate organic compound is derived from a dicarboxylic, tricarboxylic or tetracarboxylic acid.

10. The process according to claim 1, wherein the layer of the porous metal-organic framework has a mass in the range from 0.1 $g/m^2$ to 100 $g/m^2$.

* * * * *